US006431277B1

(12) United States Patent
Cox et al.

(10) Patent No.: US 6,431,277 B1
(45) Date of Patent: Aug. 13, 2002

(54) LINER HANGER

(75) Inventors: James D. Cox, Spring; John L. Baugh, Houston; Sidney K. Smith, Jr., Conroe; George E. Givens; Rodney D. Bennett, both of Houston, all of TX (US); Timothy Wootan, New Orleans, LA (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/671,788

(22) Filed: Sep. 27, 2000

Related U.S. Application Data

(60) Provisional application No. 60/156,831, filed on Sep. 30, 1999.

(51) Int. Cl.[7] ..... E21B 23/01

(52) U.S. Cl. ..... 166/208; 166/217; 166/117.6

(58) Field of Search ..... 166/75.14, 86.1, 166/88.2, 88.3, 207, 208, 217, 117.6, 117.5

(56) References Cited

U.S. PATENT DOCUMENTS

| | | | | |
|---|---|---|---|---|
| 3,608,634 A | | 9/1971 | Cochran | |
| 3,871,447 A | * | 3/1975 | Crowe | 166/120 |
| 3,999,605 A | | 12/1976 | Braddick | |
| 4,060,131 A | | 11/1977 | Kenneday et al. | |
| 4,096,913 A | * | 6/1978 | Kenneday et al. | 166/290 |
| 4,311,194 A | | 1/1982 | White | |
| 4,497,368 A | | 2/1985 | Baugh | |
| RE31,881 E | | 5/1985 | Lindsey, Jr. | |
| 4,640,354 A | | 2/1987 | Boisson | |
| 4,711,316 A | | 12/1987 | Baugh et al. | |
| 4,712,614 A | | 12/1987 | Allwin et al. | |
| 4,712,615 A | | 12/1987 | Dockins, Jr. et al. | |
| 4,762,177 A | | 8/1988 | Smith, Jr. | |
| 4,898,245 A | * | 2/1990 | Braddick | 166/387 |
| 4,942,924 A | | 7/1990 | Duncan | |
| 5,086,845 A | | 2/1992 | Baugh | |
| 5,318,131 A | | 6/1994 | Baker | |
| 5,417,288 A | | 5/1995 | Melenyzer et al. | |
| 5,560,426 A | * | 10/1996 | Trahan et al. | 166/120 |
| 5,799,730 A | * | 9/1998 | Lam et al. | 166/75.14 |
| 5,829,531 A | * | 11/1998 | Herbert et al. | 166/382 |

FOREIGN PATENT DOCUMENTS

| | | |
|---|---|---|
| GB | 2165282 A | 4/1986 |
| GB | 2165282 A | 4/1986 |
| WO | PCT/US92/02497 | 4/1992 |
| WO | WO93/20329 | 11/1993 |

* cited by examiner

*Primary Examiner*—Frank Tsay
(74) *Attorney, Agent, or Firm*—Steve Rosenblatt

(57) ABSTRACT

A liner hanger assembly has a slip actuation system which is locked for run-in. A piston assembly bolts onto the mandrel in a sealable manner to actuate a mechanical lock. Upon release of the lock, a plurality of springs actuate a sleeve which is in turn attached to the slips to move them relative to their slip seats. The slip seats are preferably mounted to the mandrel without welding and have longitudinal spaces for mud or cement flow therebetween. Load is distributed from each slip through its slip seat into the mandrel without interaction from an adjacent slip or slip seat. A rupture disk ensures that a predetermined pressure is built up before the piston can actuate to defeat the lock. The lock can come in a variety of configurations. One of which is a sliding sleeve over a dog and another is a yoke over a split ring which, when shifted, allows the split ring to expand, thus unlocking the parts. The slips can also be configured to allow flow of mud or cement behind them, thus reducing the resistance to flow of such materials.

21 Claims, 20 Drawing Sheets

LINER HANGER

The application claims the benefit of U.S. Provisional Application No. 60/156,831, filed on Sep. 30, 1999.

FIELD OF THE INVENTION

The field of this invention relates to liner hangers, and, more particularly, to the techniques for securing liner hangers in well bores.

BACKGROUND OF THE INVENTION

Liner hangers are secured in the well bores by slips. Actuation systems for such slips in the past brave employed full circumference hydraulically actuated pistons to move the slips. These designs presented a pressure rating problem in that the full circumference piston frequently had a maximum working pressure significantly lower than the mandrel which it surrounded. Thus, this type of design limited the maximum working pressure in the string to the rating of the cylindrical piston housing assembly. For example, it was not unusual in prior designs to have mandrels rated for 12,000 PSI while the surrounding cylinder housing for the cylindrical piston to only have a rating of approximately 3,000 PSI. In an effort to improve the shortcoming of this design, another design illustrated in U.S. Pat. No. 5,417,288 was developed. In this design the mandrel body received a pair of bores straddling each of the slips. A piston assembly was mounted in each of the bores with all of the necessary seals. The application of hydraulic pressure in the mandrel into all the piston bores actuated the pistons on either side of each slip through a common sleeve to which all the slips were attached. This design, however, was expensive to manufacture and had many potential leak paths in the form of the ring seals on each of the pistons wherein each slip required two pistons. This design, however, did provide for a higher pressure rating for the liner hanger body. It also used the hydraulic pressure directly to actuate the slips. Necessarily it did not include a locking feature against premature slip movements due to inadvertently applied pressures. The design in the U.S. Pat. No. 5,417,288 also did not provide for flexibility for changed conditions down-hole which could require additional force to set the slips. In essence, each application was designed for a pre-existing set of conditions with field variability not included as a feature of that prior art design.

Slip assemblies in the past have been configured in a variety of ways. In one configuration, when the slips are actuated, the load is passed through the slips circumferentially through their guides or retainers and transmission of the load to the underlying mandrel is avoided. In other more traditional designs, the slips are driven along tapered surfaces of a supporting cone and the loading is placed on the supporting mandrel is in a radial direction toward its center, thus tending to deform the mandrel when setting the slips. Typical of such applications are U.S. Pat. Nos. 4,762,177, 4,711,326 and 5,086,845.

The design of the liner hanger needs to accommodate circulation of mud and cement. The prior designs, particularly those using a cylindrical piston, obstructed the passages that could have been used for circulating cement and mud.

The apparatus of the present invention has many objectives. A versatile actuation system for a locking system is provided. The apparatus uses a combination of hydraulic pressure to defeat a locking mechanism which in turn allows mechanical actuation of the slips. The slips are configured to pass the loading into the slip seat and then into the mandrel in a manner so as not to deform the mandrel. The slips act independently of each other and transfer their load through the surrounding slip seat directly to the mandrel. The slip seats are attached to the mandrel without welding because standard setting organizations and well operators have restrictions against connecting parts made of certain materials by welding or against welding altogether in down-hole tools. The slip seats are spaced from each other to provide flow channels along the exterior of the liner hanger to facilitate the movement of cement or mud. Those passages are continued for the length of the tool. The actuating piston assembly to defeat the lock mechanism is a bolt-on arrangement which can be readily interchanged in the field to react to changing down-hole conditions. The actuating piston is fully compensated for thermal effects and a system is provided to vent any gases from the piston actuation system which is used to defeat the lock. The lock can be in a number of alternative styles. One of which involves using a dog to hold the parts together for run in and liberating the dog from its groove to allow setting of the slips, which is preferably done by a plurality of springs. The parts are also disposed in a preferred spacing to make maximum use of the limited force available from the piston assembly for releasing the lock. The lock configuration can also be in the form of a split ring held together by a yoke which allows relative movement when the yoke is shifted, allowing the split ring to expand. These and other objectives of the present invention will become more apparent to those skilled in the art from a review of the preferred and alternative embodiments described below.

SUMMARY OF THE INVENTION

A liner hanger assembly has a slip actuation system which is locked for run-in. A piston assembly bolts onto the mandrel in a sealable manner to actuate a mechanical lock. Upon release of the lock, a plurality of springs actuate a sleeve which is in turn attached to the slips to move them relative to their slip seats. In an alternative embodiment, a plurality of springs can directly move the slips relative to their slip seats, when the springs are released. The slip seats are preferably mounted to the mandrel without welding and have longitudinal spaces for mud or cement flow therebetween. Load is distributed from each slip through its slip seat into the mandrel without interaction from an adjacent slip or slip seat. A rupture disk ensures that a predetermined pressure is built up before the piston can actuate to defeat the lock. The lock can come in a variety of configurations. One of which is a sliding sleeve over a dog and another is a yoke over a split ring which, when shifted, allows the split ring to expand, thus unlocking the parts. Yet another variant is a yoke restraining a split ring. The slips can also be configured to allow flow of mud or cement behind them, thus reducing the resistance to flow of such materials.

DETAILED DESCRIPTION OF THE DRAWINGS

FIGS. 1A through C are a plan view of the apparatus looking down on the spring housing;

Figure 7A:
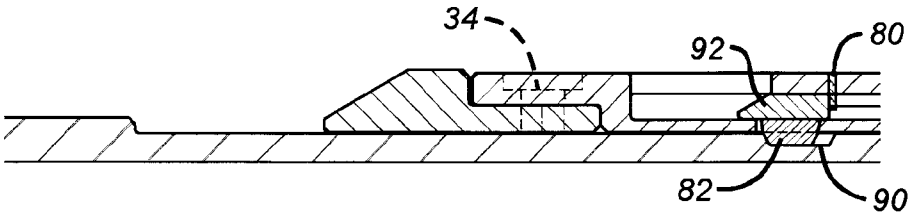
Figure 9A:
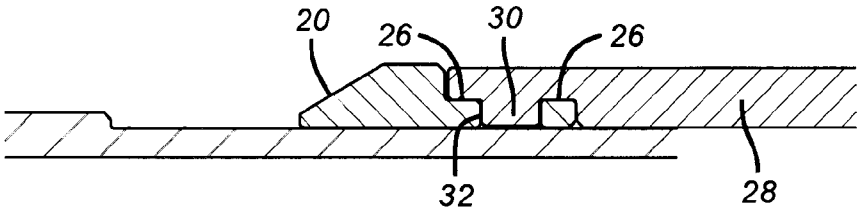
Figure 7B:
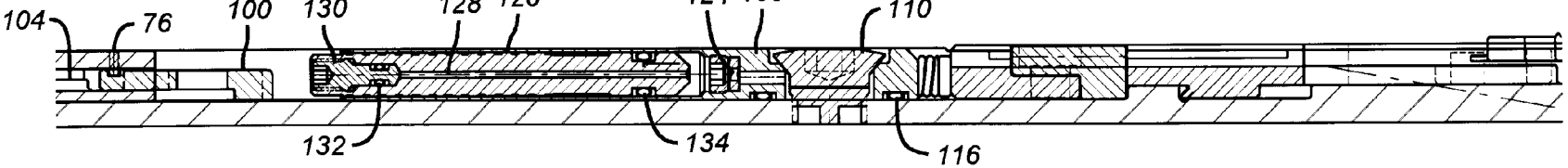
Figure 9B:
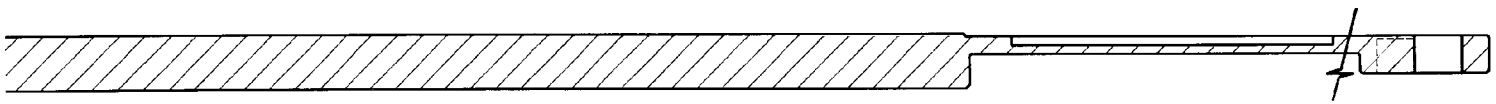
Figure 7C:
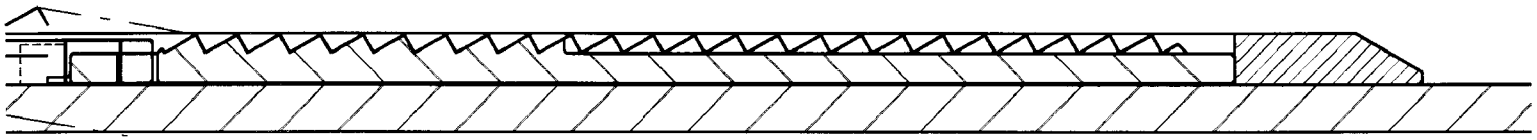
Figure 10:
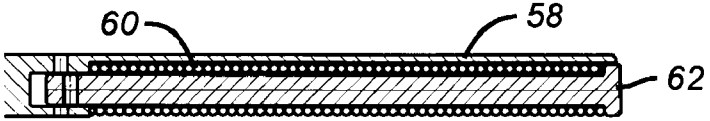

FIGS. 7A through C are a section view through the lock housing during the run-in position;

FIG. 8 is the section view through the piston housing in the set position when the lock has been defeated.;

FIG. 9 illustrates the connection between the spring housing and the gage ring;

FIG. 10 illustrates the springs used to set the slips and the guide for each spring in section through either the spring housing or the lock housing.

Figure 11:
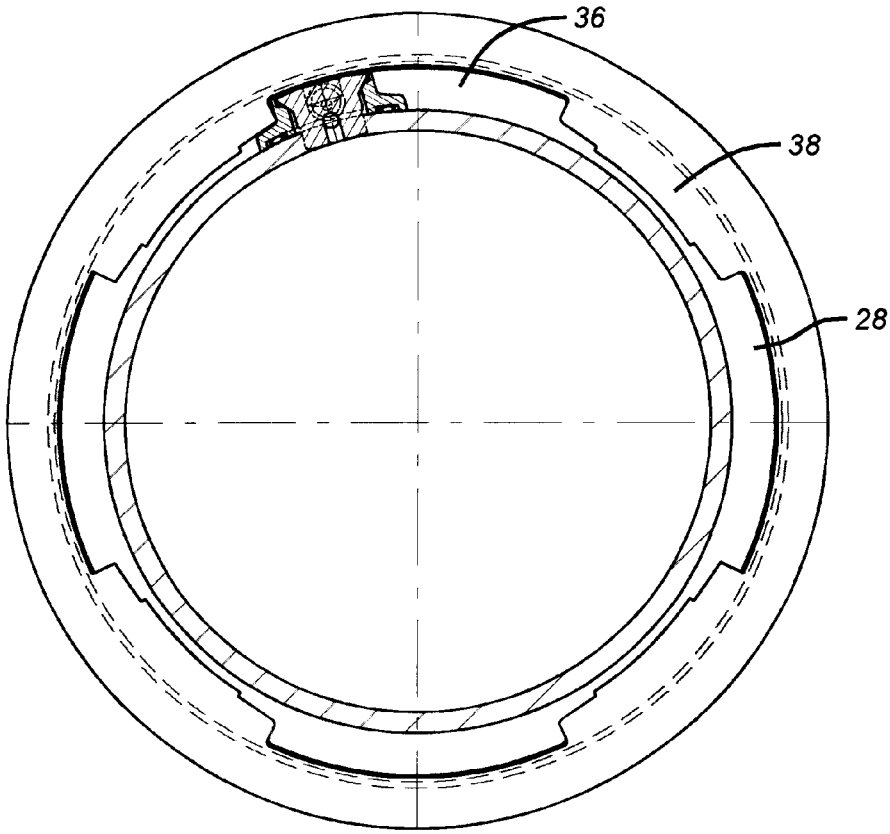
Figure 12:
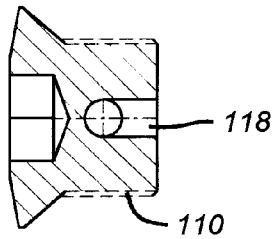
Figure 13:
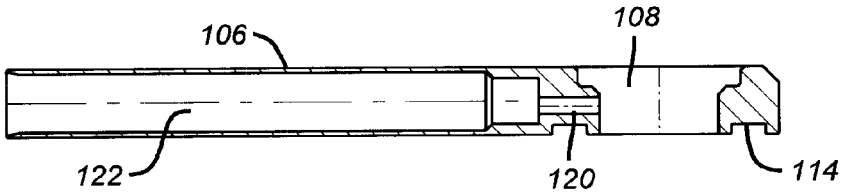
Figure 14:
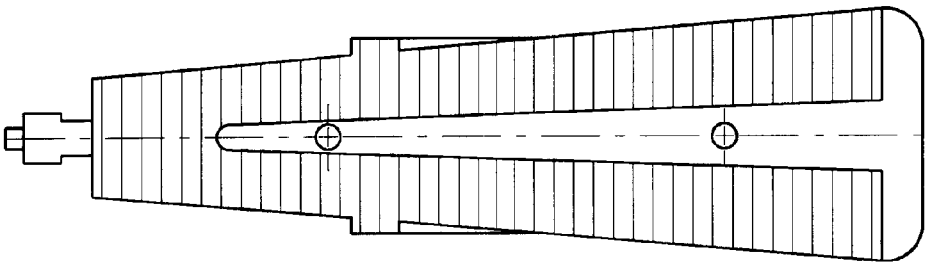
Figure 15:
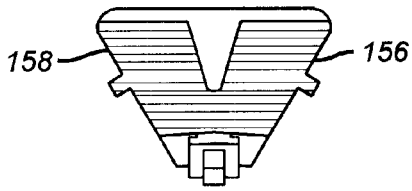
Figure 16:
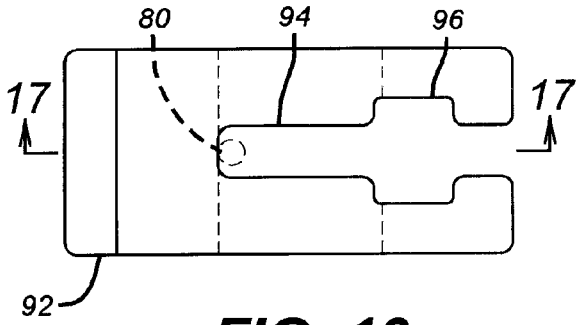
Figure 18:
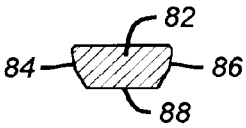
Figure 19:
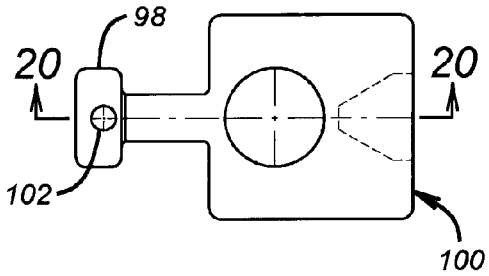
Figure 17:
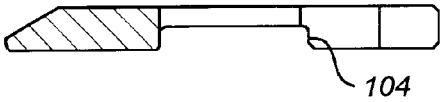
Figure 20:
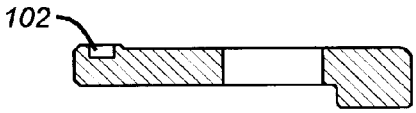
Figure 21:
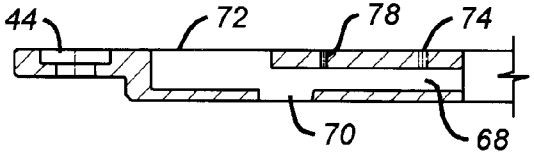
Figure 22:
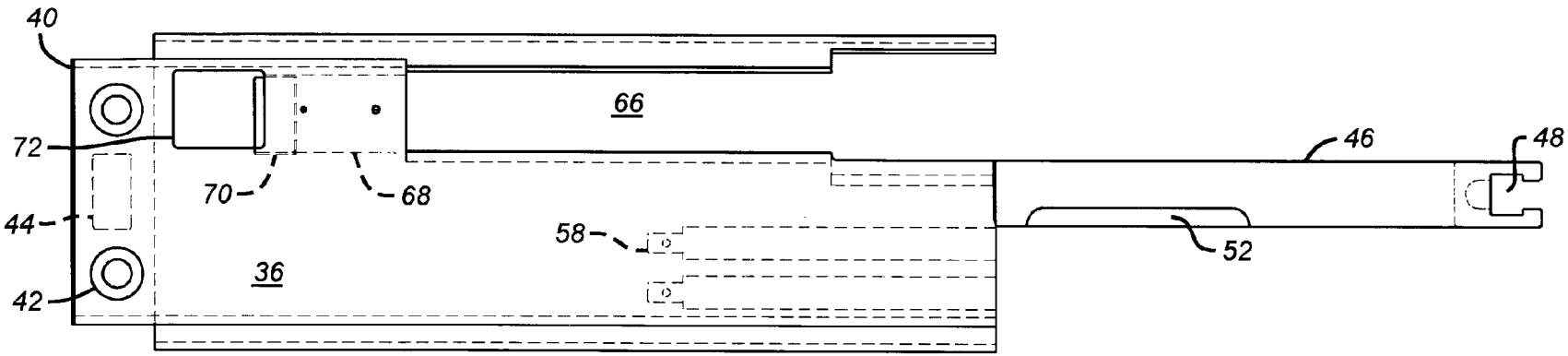
Figure 25:
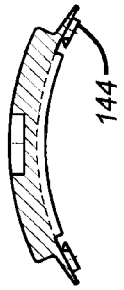
Figure 26:
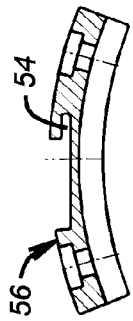
Figure 23:
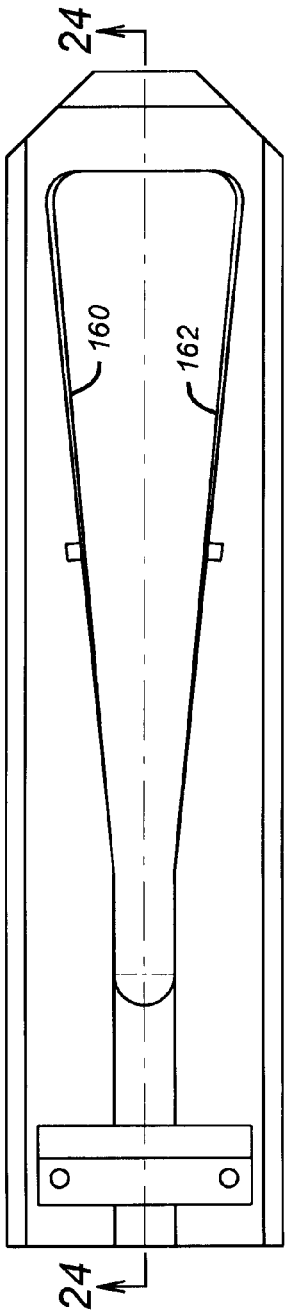
Figure 24:
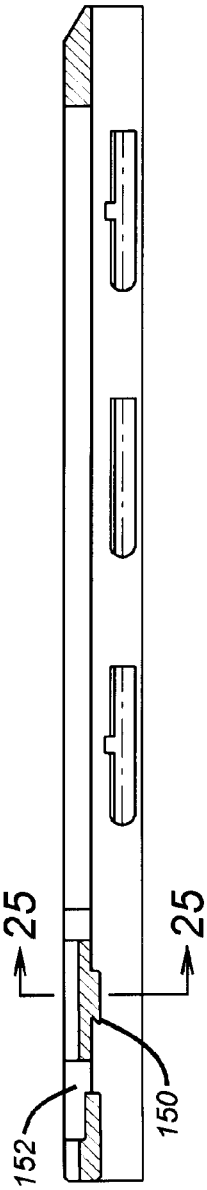
Figure 27:
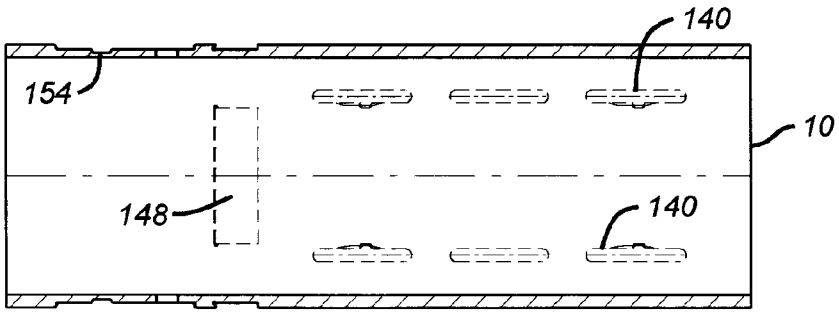
Figure 29:
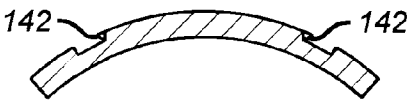
Figure 28:
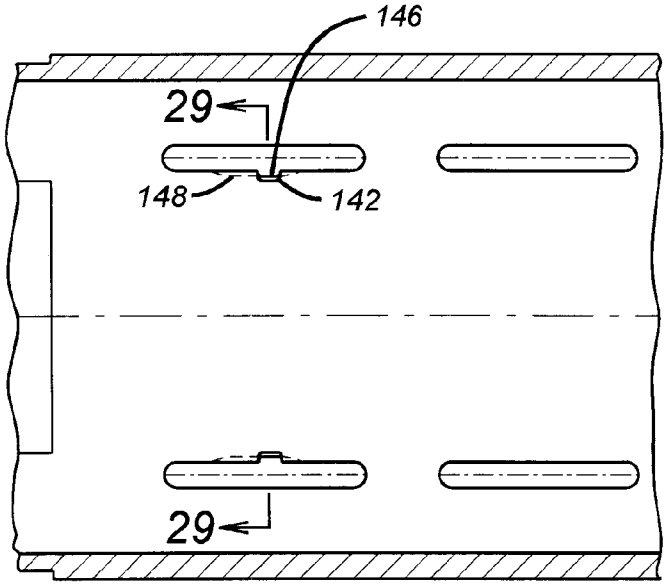
Figure 30A:
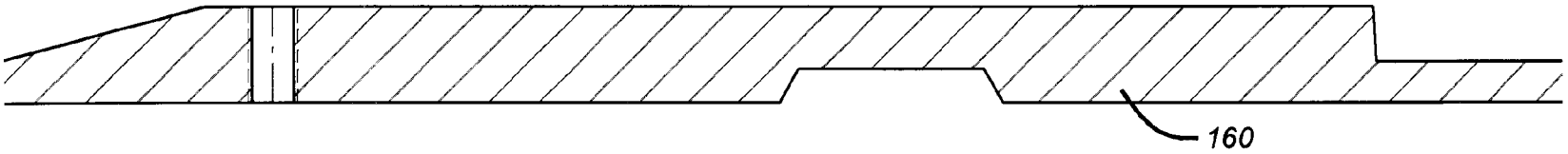
Figure 30B:
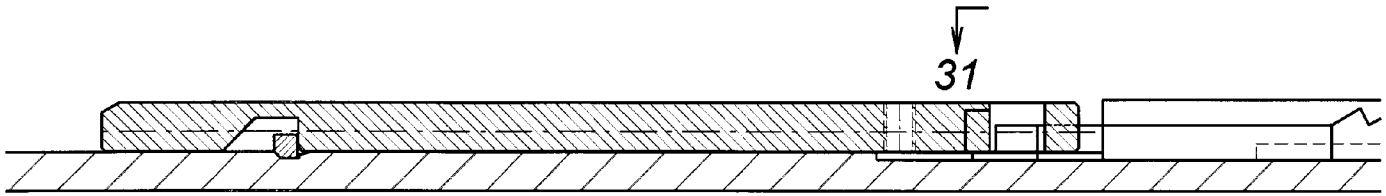
Figure 32B:
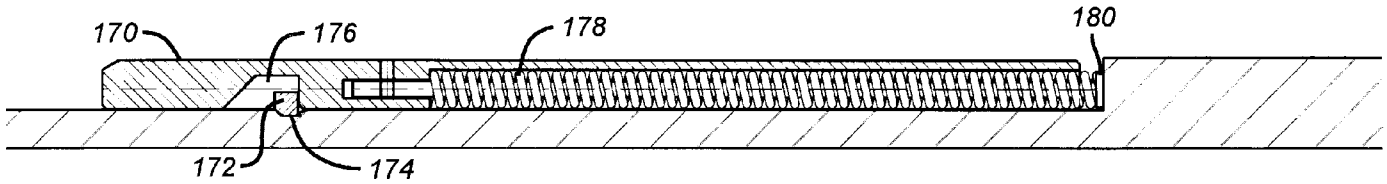
Figure 33B:
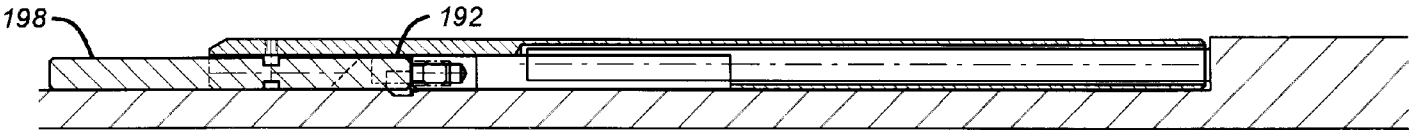
Figure 30C:
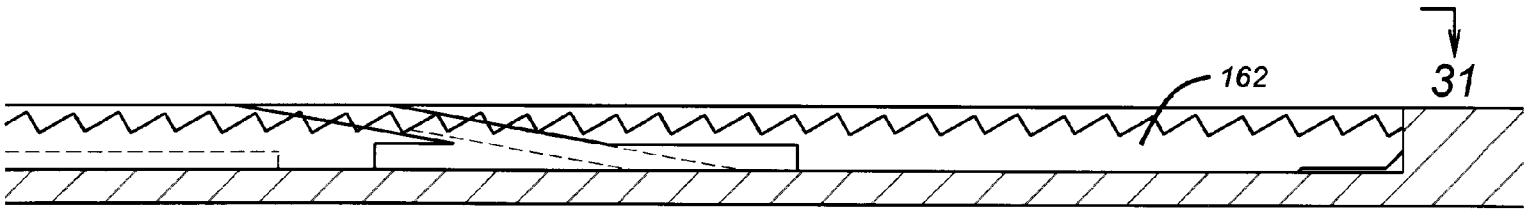
Figure 31:
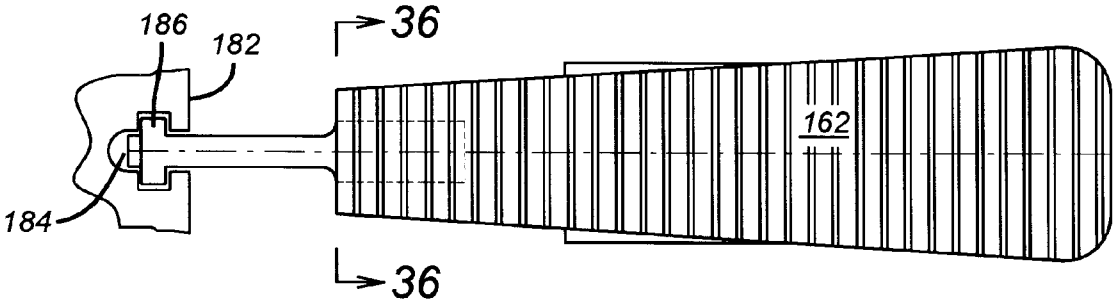

FIG. 11 is a top view showing the longitudinal passages that facilitate the flow of cement or mud;

FIG. 12 is a section view through the piston housing retainer bolt showing the passages therethrough;

FIG. 13 is a section view through the piston housing showing the passages from the retainer bolt to the rupture disk location;

FIG. 14 is a plan view of one of the slips;

FIG. 15 is a perspective view of the same slip shown in FIG. 14, showing the slip in perspective and the sloping end surfaces;

FIG. 16 is a plan view of the lock dog retainer;

FIG. 17 is a section view through lines 17—17 in FIG. 16;

FIG. 18 is a section view of the lock dog;

FIG. 19 is a plan view of the lock dog release;

FIG. 20 is a section view through lines 20—20 of FIG. 19;

FIG. 21 is a partial section through the longitudinal interior passage in the lock housing which in part holds the locking dog;

FIG. 22 is a plan view of the lock housing;

FIG. 23 is a plan view of the slip seat;

FIG. 24 is a section view through lines 24—24 of FIG. 23;

FIG. 25 is a section view through lines 25—25 of FIG. 24;

FIG. 26 is a section through the slip seat retainer;

FIG. 27 is a plan view of the mandrel;

FIG. 28 is a more detailed plan view of the mandrel;

FIG. 29 is a section through lines 2929 of FIG. 28;

FIG. 30 is a section view of an alternative embodiment taken through one of the slips;

FIG. 31 is a plan view of the slip shown in FIG. 30 taken along line 31—31 of FIG. 30.

Figure 32A:
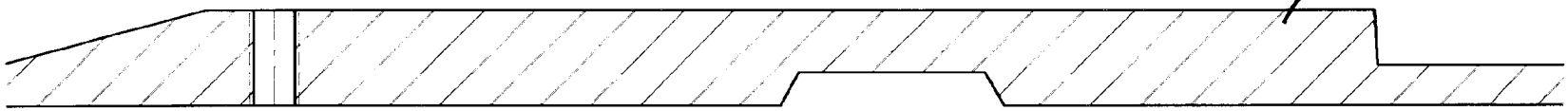
Figure 33A:
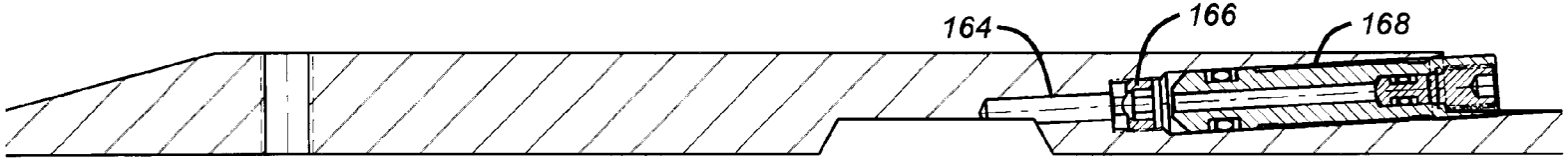
Figure 35:
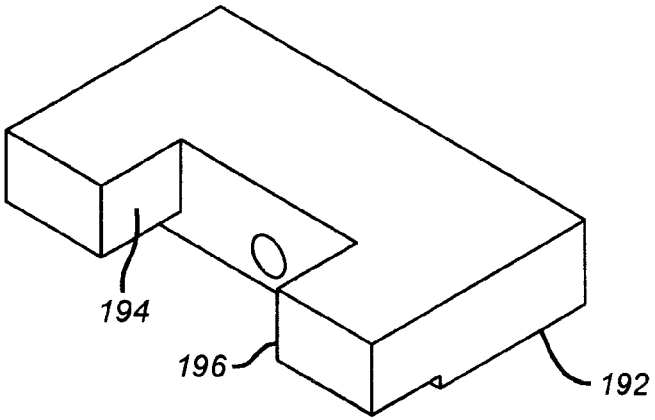
Figure 36:
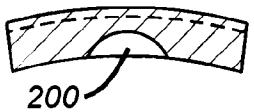
Figure 34:
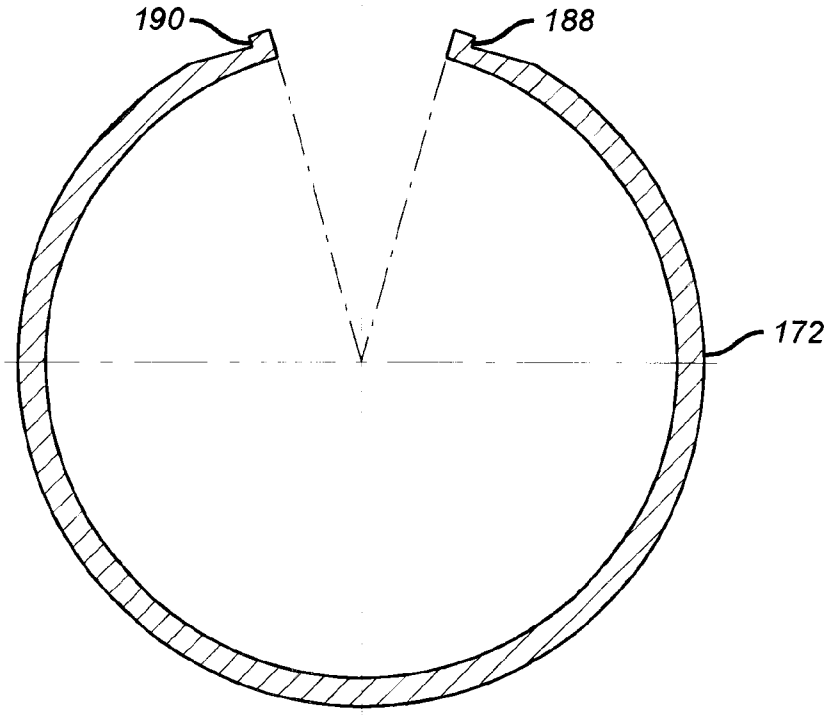

FIGS. 32A and B are the view of FIGS. 30 A through C rotated to show the spring housings;

FIGS. 33A and B are the view of FIGS. 30 A through C rotated to show the spring housings;

FIGS. 33A and B are the view of FIGS. 30 A through C further rotated to show the locking feature;

FIG. 34 is an elevation view of the snap ring;

FIG. 35 is an isometric view of the internal key;

FIG. 36 is a view taken along lines 36—36 of FIG. 31.

Figure 36A:
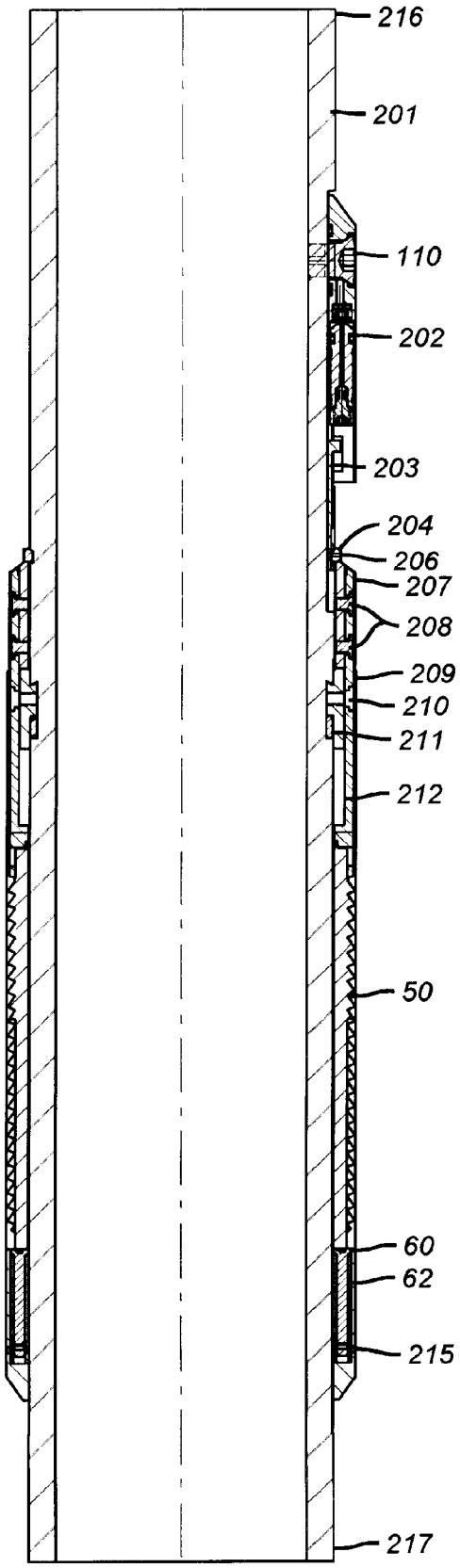

FIG. 36*a* illustrates a longitudinal cross section of the tool through the piston assembly, lock mechanism, slip and slip seat.

Figure 37:
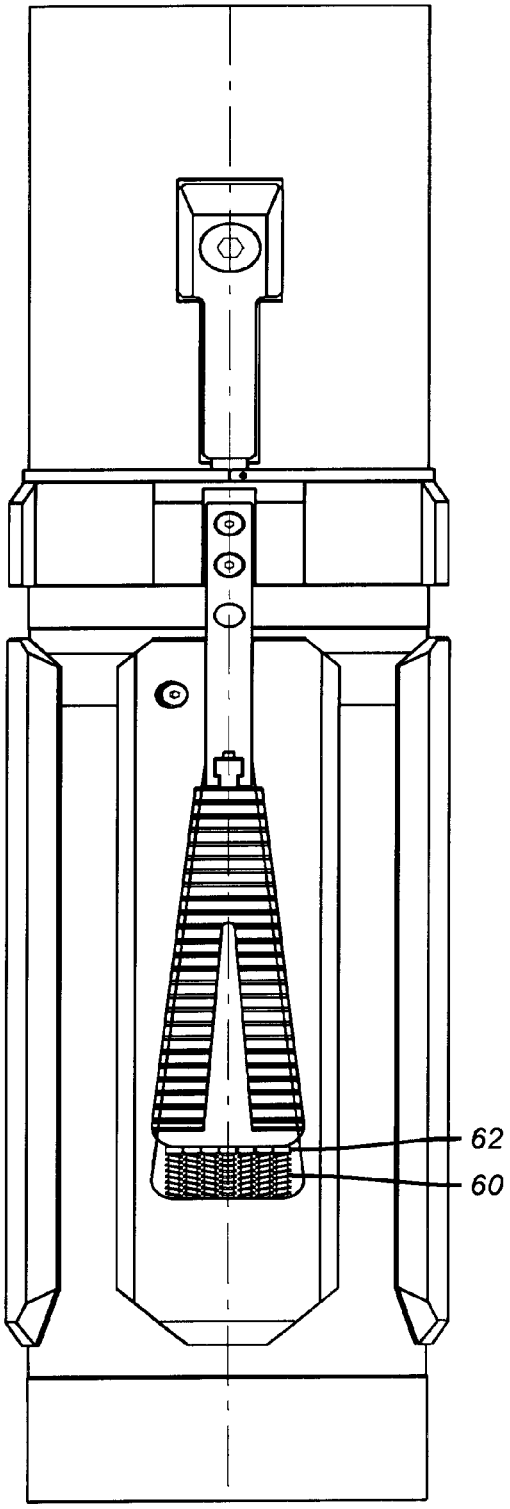

FIG. 37 is a plan view of the tool in the set position.

Figure 38:
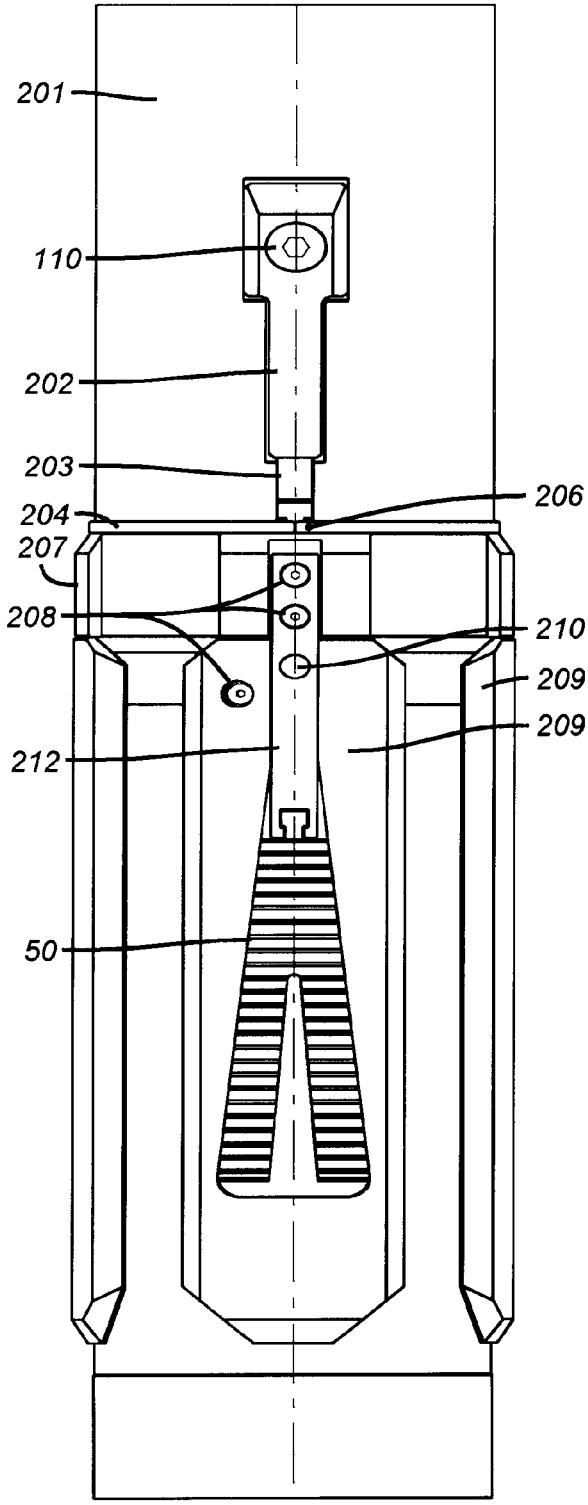

FIG. 38 is a plan view of the tool in the run-in position.

Figure 39:
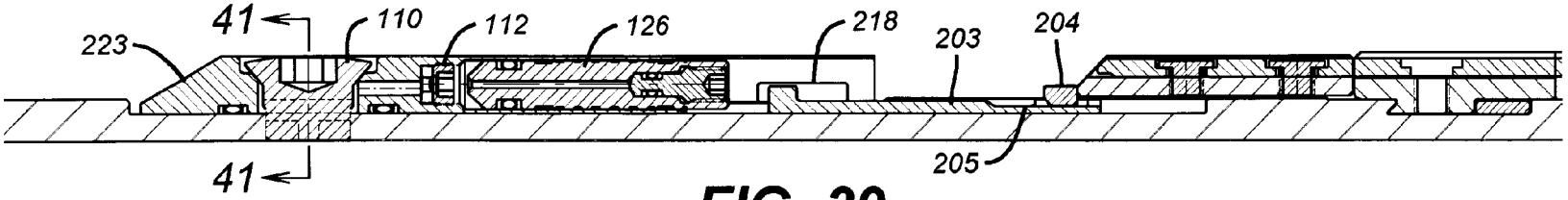

FIG. 39 is a section view of the piston assembly and lock mechanism in the run-in position.

Figure 40:
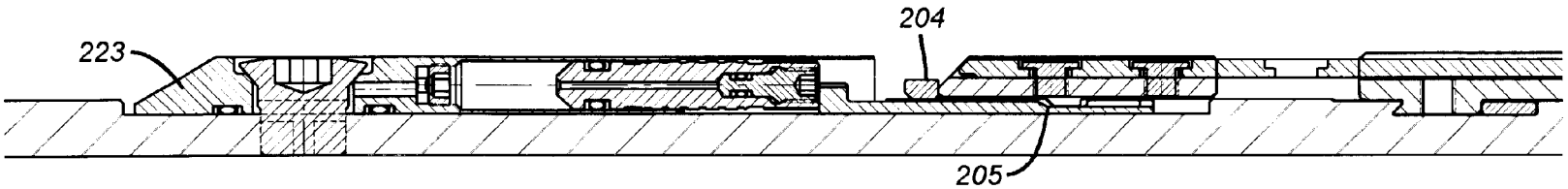

FIG. 40 is a section view of the piston assembly and lock mechanism in the set position.

Figure 41:
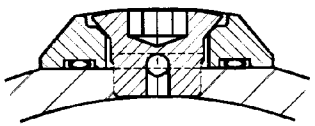

FIG. 41 is a section view through FIG. 39, of the piston assembly bolted to the mandrel.

Figure 42:
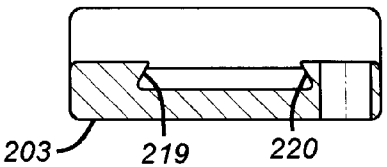

FIG. 42 is an end view of the lock.

Figure 43:
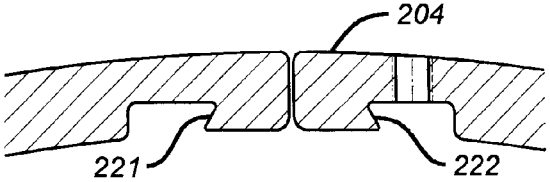

FIG. 43 is an end view of the snap ring.

DETAILED DESCRIPTION OF THE PREFERRED EMBODIMENT

Referring to FIGS. 1 through 11, the major components of the apparatus in A will now be described. Apparatus A has a mandrel 10 which has a lower end 12. Lower end 12 is shown schematically and those skilled in the art will appreciate that the liner string is connected at lower end 12. The mandrel 10 has an upper end 14 to which those skilled in the art will appreciate is attached a running string for proper positioning of securing assembly S shown in FIGS. 1A through C. The mandrel 10 has a shoulder 16 which defines a reduced diameter segment 18.

Figure 1A:
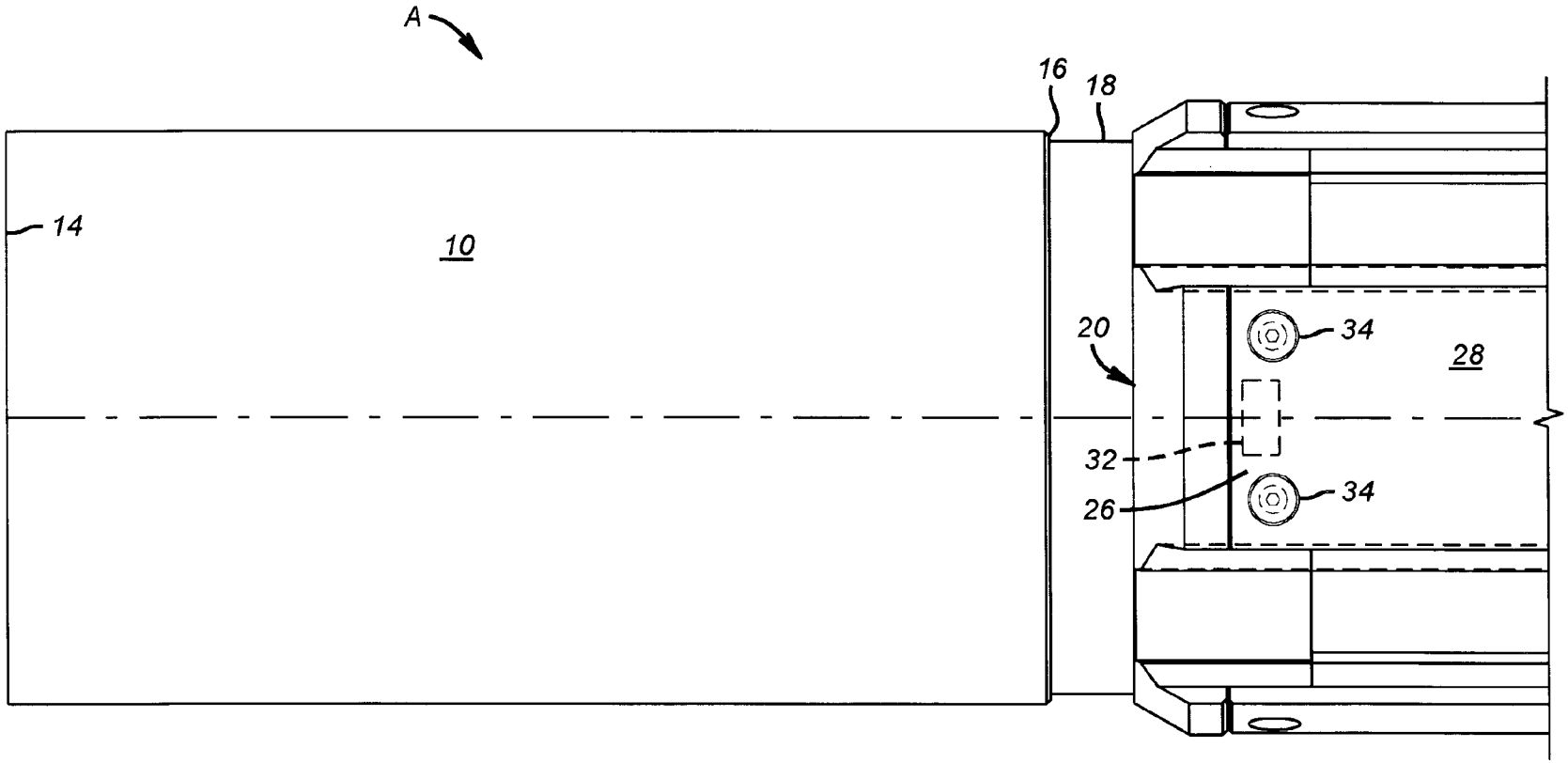
Figure 3:
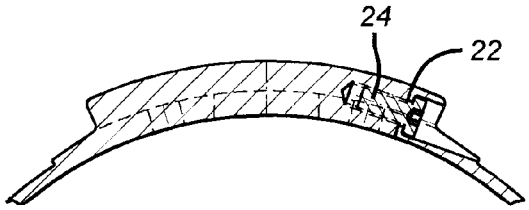
FIG. 3 is a section view through lines 3—3 of FIG. 2.
Figure 4:
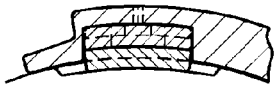
FIG. 4 is a section of lines 4—4 of FIG. 2.
Figure 5:
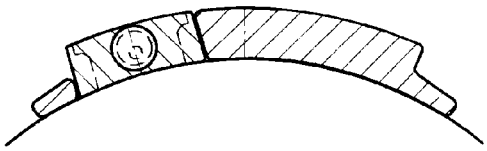
FIG. 5 is a section through lines 5—5 of FIG. 2.

A gage ring 20 is shown in FIGS. 1A and in section in FIG. 3. The gage ring 20 has a split 22 (see FIG. 3) and a draw bolt 24 so as to bring the components of the gage ring 20 together at split 22 once the gage ring 20 has been advanced beyond the shoulder 16 and onto the reduced diameter segment 18. Gage ring 20 has several flats, one of which 26 is shown in interrupted form in FIG. 9. FIG. 9 is a section view through the gage ring 20 showing the spring housing 28 mounted to it.

By comparing FIGS. 1A and 9, it can be seen that the spring housing 28 has a tab 30 which extends into a window 32 in flat 26 of gage ring 20. In that manner as shown in FIG. 9, the position of the spring housing 28 is initially fixed to the gage ring 20 and that engagement is secured by bolts 34.

Figure 1B:
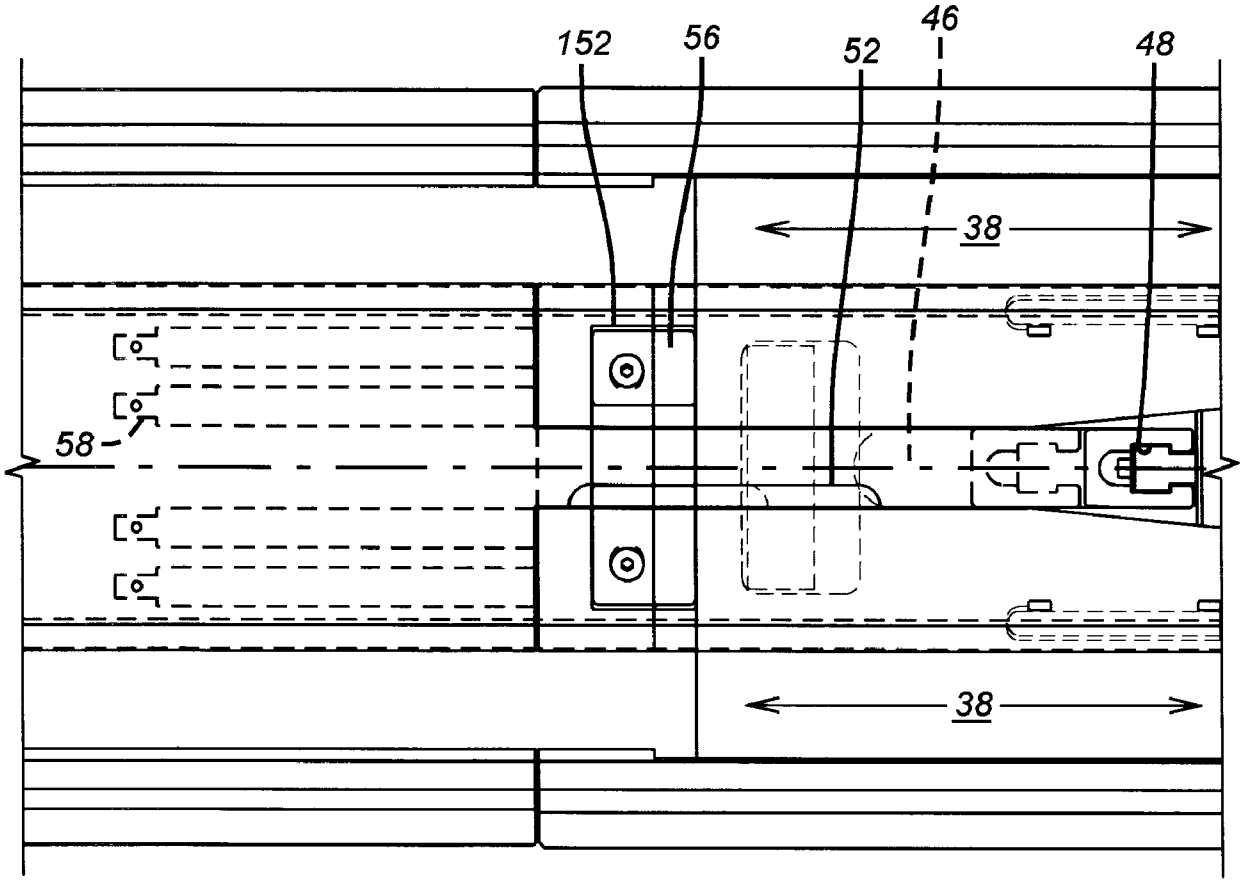
Figure 1C:
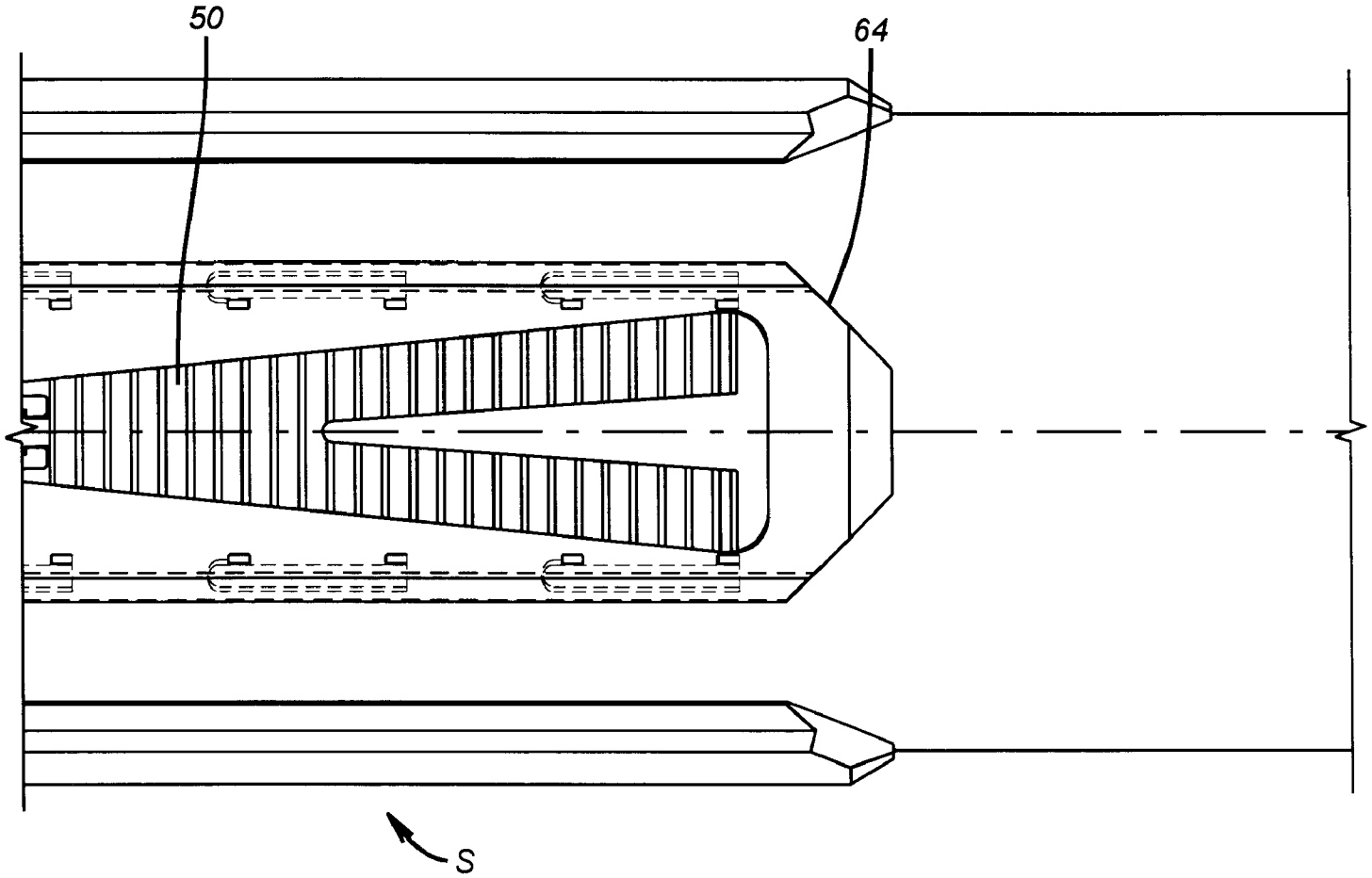
Figure 2:
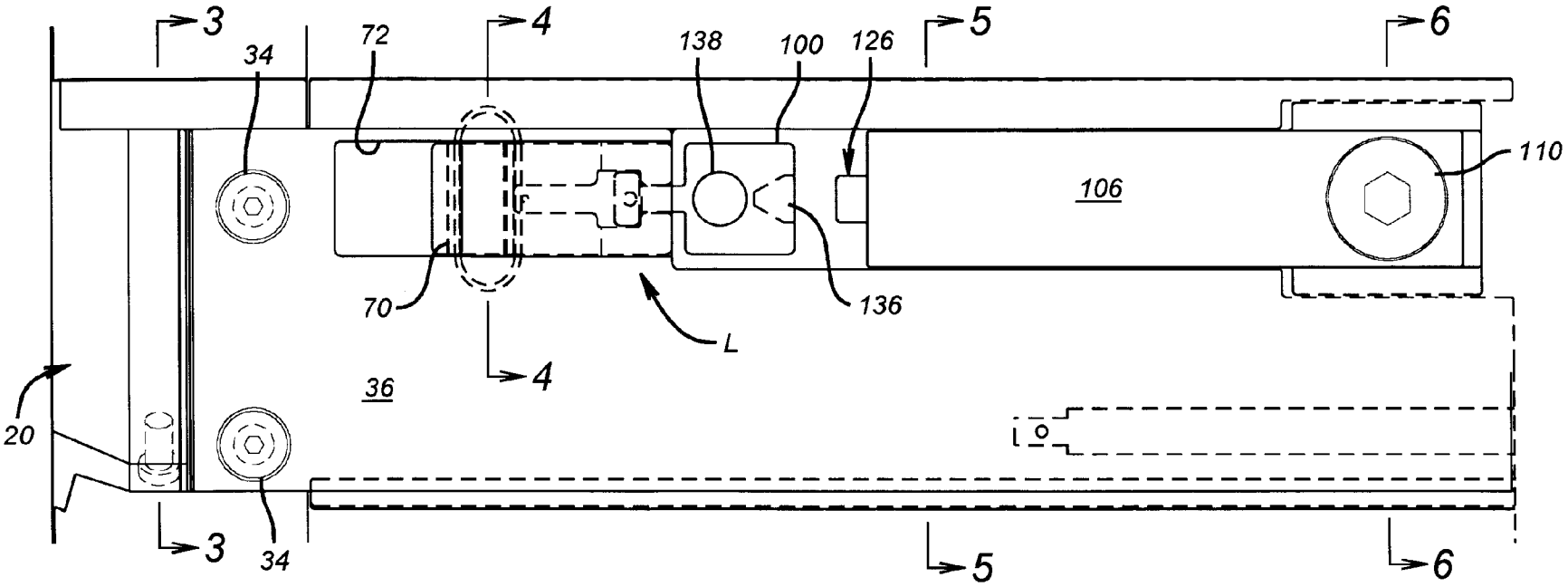
FIG. 2 is a rotated view from the view of FIGS. 1A and B showing a plan view of the lock housing.

FIG. 2 shows a rotated view from FIGS. 1A and B, indicating that the gage ring 20 also supports the lock housing 36. The number of spring housings 28 can vary without departing from the spirit of the invention. In the preferred embodiment disclosed, there are three spring housings 28 and one lock housing 36, generally at 90 degree spacings, thus defining elongated passages 38 therebetween (see FIG. 11), these passages 38 shown schematically in FIG. 1B allow mud or cement to pass relatively unimpeded.

Referring again to FIG. 2, the lock housing 36 is secured to the gage ring 20 by bolts 34.

Referring to FIG. 22, a top view of the lock housing 36 is illustrated. It has a top end 40 adjacent to which are the openings 42 through which the bolts 34 are inserted. Also shown in hidden lines is a downwardly oriented tab 44 which is placed through a corresponding opening or window in the gage ring 20, similar to the method of attachment shown in FIG. 1A. The lock housing 36 also has an extending arm 46 which is rectangular in cross-section and includes a receptacle 48 for engagement of a slip 50 (see FIG. 1B). It should be noted that FIG. 1B illustrates in dashed lines the movement of receptacle 48 into a second position which reflects the setting of the slip 50. Arm 46, shown in FIG. 22 also has an oblong undercut 52 which fits into slot 54 of slip seat retainer 56 (see FIGS. 26 and 1B). In that manner the slot 54 acts as a guide to the longitudinal motion of lock housing 36. It also holds arm 46 against centrifugal force created by rotation of the apparatus A at speeds as high as about 250 RPM. The same configuration is found in the spring housing 28 shown in FIGS. 1A through C employing the identical undercut 52 with the same slip seat retainer 56 providing a slot 54 to guide an arm 46 which in turn through receptacle 48 secures yet another slip 50. It should be noted that FIG. 2 is a partial view of the lock housing 36 shown in a rotated position from the view of FIG. 22, and therefore, it does not show the arm 46 or receptacle 48 at the end of it which is used to connect to a slip 50. Referring again to FIG. 22, the lock housing 36 has a series of blind bores 58, two of which are shown in FIG. 22 in hidden lines. A section through one of the blind bores 58 is seen in FIG. 10. There, a spring 60 surrounds a spring retainer 62. In the run-in position, the spring 60 is compressed so that when the lock mechanism L is released, the energy stored in spring 60 is also released allowing upward movement of the gage ring 20 as shown by comparing FIGS. 7 and 8. Initially, however, each of the spring housings 28 has a plurality of blind bores 58 (see FIG. 1B), each of which has a spring 60 and a retainer 62 mounted therein. The number of springs and the size of the spring 60 can vary without departing from the spirit of the invention. Those skilled in the art will appreciate that the number of available spring 60 and their size will dictate the amount of upward force that can be exerted on gage ring 20 which pulls up with it the spring housing 28 and the lock housing 36, which in turn pull slips 50 relative to slip seat 64, securing assembly S to a tubular in the well bore.

One version of the lock mechanism L will now be described. The lock housing 36 has a multi-dimensional longitudinal opening 66 (see FIG. 22). As shown in FIG. 22, the opening 66 extends for a significant length of the piece and then continues as a bore 68 which has a generally rectangular cross-section with a downwardly depending opening 70, shown in hidden lines in FIG. 22 and a subsequent upwardly depending opening 72. These features can be better seen in the section view of the lock housing 36 illustrated in FIG. 21. In FIG. 21, bore 68 is illustrated with an opening 74 for insertion of a breakable pin 76 (see FIG. 7B). Further down bore 68 is another opening 78 for the insertion of a guide pin 80 (see FIG. 7A). Finally, the downwardly oriented opening 70 and upwardly oriented opening 72 are illustrated as well as one opening 42 for attachment to the gage ring 20. The downwardly oriented opening 70 accepts a dog 82. Its tapered up-hole and down-hole surfaces 84 and 86 (see FIG. 18) are illustrated to be disposed at preferably an 80 degree angle measured from the lower end 88 of dog 82. Dog 82 sits in notch 90 on the mandrel 10 as shown in FIG. 7A. Notch 90 has tapered surfaces conforming to the tapered surfaces 84 and 86 of dog 82. While 80 degrees is preferred, other angles can be used without departing from the spirit of the invention. The matching taper angles between the dog 82 and the receptacle 90 facilitate in driving the dog 82 out of receptacle 90. In the run-in position shown in FIG. 7A, the dog 82 is retained by lock dog retainer 92. As show in FIGS. 7A and B, the lock dog retainer 92 overlays the dog 82 holding it in the notch 90 on mandrel 10. Referring to FIG. 16 which is a top view of the lock dog retainer 92, an elongated slot 94 accepts the guide pin 80 which extends through the lock housing 36. In that manner, the guide pin 80 limits the down-hole movement of lock dog retainer 92. This concept is illustrated in FIG. 16 by placement of guide pin 80 in the slot 94 to illustrate that only movement up-hole or to the left in FIG. 16 is possible for lock dog retainer 92. Lock dog retainer 92 has a receptacle 96 shown in FIG. 16. As shown in FIGS. 19 and 20, receptacle 96 accommodates tab 98 of lock dog release 100. In an important feature, the width of tab 98 is shorter than the length of receptacle 96, thus allowing for the possibility of relative motion therebetween. For the run-in position, the lock dog release 100 has a receptacle 102 (see FIGS. 19 and 20) which accepts pin 76, which in turn extends through the lock housing 36. Thus, for run-in, the lock dog release 100 is pinned to the lock housing 36 and has a tab 98 inserted into receptacle 96 of lock dog retainer 92. FIG. 16 shows the maximum down-hole position of lock dog retainer 92 due to the travel limitation of guide pin 80 extending into slot 94. In the position shown in FIG. 16, the tab 98 of lock dog release 100 is so positioned in receptacle 96 so as to be able to move up-hole, i.e. toward pin 80 for a limited distance before tandem movement of lock dog release 100 and lock dog retainer 92 occurs. The significance of the relative movement will be explained later.

Referring to the section view of the lock dog retainer 92 (FIG. 17), it can also be seen that it has an undercut 104 which is offset from dog 82 in FIGS. 7A and B, and shifted to coincide with dog 82 in FIG. 8. Those skilled in the art will appreciate that when the undercut 104 moves over the dog 82 the dog can be pushed out of notch 90, thus allowing an unlocking of the lock housing 36 from the mandrel 10. As previously explained, when such unlocking of the lock mechanism L occurs, the various springs 60 bearing on their respective retainers 62 collectively expand up hole, moving the spring housings 28 and the lock housing 36, along with gage ring 20 to which housings 28 and 36 are connected, which has the ultimate effect of pulling the slips 50 to set them.

In order to actuate the lock mechanism L to unlock and permit setting of the slips 50 a release device is required. In this instance, the release device comprises a piston housing 106 which has internal passages which are best seen in FIG. 13. Passage 108 accepts a bolt 110 whose details are best shown in FIG. 12. Bolt 110 is placed over an opening 112 in the mandrel 10. The piston housing 106 has a circular groove 114 which accepts a sealing member, such as an O-ring 116 (see FIG. 7B). With bolt 110 securing the piston housing 106 about the opening 112, there is a sealed passage from inside the mandrel 10 through the bolt 110, through its passage 118 (see FIG. 12). Passage 118 in bolt 110 is sealingly aligned to passage 120 in piston housing 106. Passage 120 leads to passage 122 within which are mounted a rupture disk 124 and a piston assembly 126 (see FIG. 7B).

FIG. 7B shows the rupture disk 124 adjacent the piston assembly 126 all within the passage 122 of the piston housing 106. The purpose of the rupture disk 124 is to insure that a certain minimum pressure is achieved in the mandrel 10 before internal pressure in mandrel 10 is communicated to the piston assembly 126. The piston assembly 126 has a central passage 128 which can be sealed by a cap 130 in combination with a seal 132. Externally, the piston assembly 126 has a seal 134 to seal it in passage 122 for reciprocal movement therein. The cap 130 allows proper displacement of air or other gases from passage 122 as the piston assembly 126 is inserted into the passage 122. Upon insertion to the position shown in FIG. 7B, the trapped fluids are displaced through passage 128 until the desired position of the piston assembly 126 is reached. At that time, the cap 130 is screwed on, sealing off the piston assembly 126 in passage 122. Prior to installing the piston assembly 126, the rupture disk 124 is inserted. The piston assembly 126 is thus free to move in opposed directions to compensate for thermal effects or other effects. As shown in FIG. 7B, there is a space between the piston assembly 126 extending out of the piston housing 106 and the lock dog release 100. This space can also be easily seen in FIG. 2. Those skilled in the art will appreciate that the piston housing 106 as well as the piston assembly 126 which is in it, can be easily replaced with a different sized unit to accommodate these specific down hole conditions as they occur. Such replacements can be done in the field without having to send the tool back to the shop. What is simply done is that the bolt 110 is loosened and a different piston housing 106, having a bigger or smaller piston, or with a rupture disk 124 set to break at a different value is easily insertible as a unit in replacement of the original equipment. Thus the bolt-on feature of the piston housing 106 holding the piston assembly 126 adds versatility to the apparatus A of the present invention and allows for field changes to meet last minute changes in well operating conditions where the apparatus A is to be set. It also facilitates the presence of passages 38.

Figure 8A:
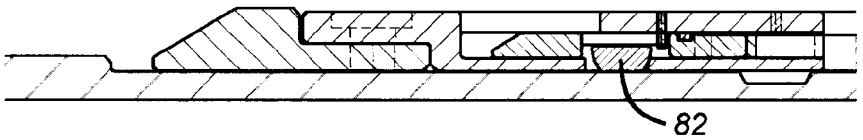
Figure 8B:
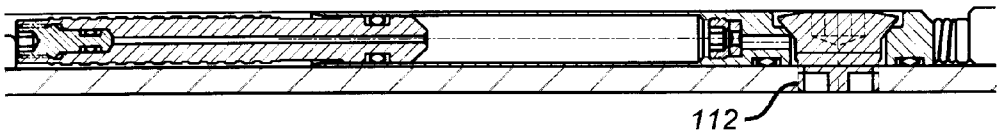

In order to set the slips 50, pressure must be built up sufficiently within the mandrel 10 to break the rupture disk 124. When the rupture disk 124 breaks, pressure is then applied to the piston assembly 126, moving the piston to the left as seen by comparing FIGS. 7B and 8B. The piston assembly 126 first impacts the lock-dog release 100, pushing it up hole. As seen in FIG. 2, the lock-dog release 100 has a downwardly oriented tab 136 adjacent to an opening 138. As shown in FIGS. 7A & B, the lock-dog release 100 is initially retained by a shear pin 76 or similar retaining device. The impact of the piston assembly 126 on the lock-dog release 100 breaks the shear pin 76 and starts the lock-dog release 100 moving up hole. It should be noted that at this time there is no movement of the lock-dog retainer 92. As previously explained, the receptacle 96 of the lock-dog retainer 92 (see FIG. 16) is longer than the width of the tab 98 on lock-dog release 100. As a result, the energy imparted into the piston assembly 126 is initially expended solely to break the shear pin 76 without also, at the same time, having a need to overcome the frictional resistance between the lock-dog retainer 92 and the dog 82, which it squeezes into notch 90. Those skilled in the art will appreciate that these movements occur almost instantaneously so that after the shear pin 76 is broken and the piston assembly 126 is moving in tandem with lock-dog release 100, the lock-dog retainer 92 is eventually driven up hole as shown in FIG. 8A. This places the undercut 104 (see FIG. 17) in alignment with dog 82. Further movement of lock-dog retainer 92 allows springs 60 to push lock housing 36 which in turn forces tapered surface 84 of dog 82 along its parallel surface in notch 90 so that the dog 82 comes out of notch 90 to the final position shown in FIG. 8A. It should be noted that as these movements are occurring, the tab 136 pushes any mud out through opening 138 in lock-dog release 100. Similarly, the uphole movement of lock-dog retainer 92 forces any adjacent mud through the upwardly oriented opening 72 in the lock housing 36.

With the dog 82 out of notch 90, the spring housings 28 and lock housing 36 are no longer held to the mandrel 10. At that point, the springs 60 in the various spring housings 28 and the lock housing 36 can push off against their respective retainers 62, thus moving uphole all of the spring housings 28 and lock housing 36 along with gauge ring 20. This upward movement shown by a comparison of FIGS. 7 & 8 results in a pull upward on all of the slips 50 which drives the slips 50 outwardly into a gripping engagement with the tubular in the well bore to set the apparatus A.

The method of securing the slips 50 to the respective slips seat 64 will now be described. Each of the slip seats 64 can be attached to the reduced diameter segment 18 of the mandrel 10 without welding. This is a distinct advantage to well operators whose requirements preclude welding as well as when certain materials are used allowing the affixation of the slip seat 64 to the mandrel in conformance with regulations that prohibit welding, such as those promulgated by the National Association of Corrosion Engineers (NACE). The mandrel 10 is shown in more detain in FIGS. 27 through 29. As seen in FIG. 27, each slip seat 64 is attachable to the mandrel 10 through a series of rows of longitudinal slots 140. Each individual slot 140 is shown in greater detail in FIG. 28. At least one opposed pair of slots, shown in FIG. 28, has a lateral opening 142, which is designed to accept a tab 144 (see FIG. 25) on the underside of the slip seat 64. The various tabs on the underside of the slip seat 64 are aligned with the longitudinal slots 140 and more particularly, the lateral openings 142. The slots 140 have elongated undercuts 146 such that the tab 144 on the underside of the slip seat 64 can be first inserted into the lateral opening 142 as shown in FIG. 28 and then the slip seat 64 can be moved longitudinally with respect to mandrel 10 to put the tabs 144 in an offset position from lateral opening 142. This position is shown in FIG. 27. Also shown in FIG. 27 is an opening 148 in the mandrel 10. Opening 148 is in fact a depression in the outer surface of mandrel 10. Referring to FIG. 24, the slip seat 64 has a transverse lug 150 which fits into the opening 148 and mandrel 10. Opening 148 is necessarily larger than the lug 150 so that upon insertion of tabs 144 and lug 150 into respective openings 140 and 148 and translation of the slip seat 64 with respect to the mandrel 10, any load transmitted to the slip seat 64 goes into the mandrel 10 via transverse lug 150 and aligned lugs 144. In essence, lugs 144 take a hanging load on upper ends of slots 140 and take up a radial load on the sides of slots 140 while transverse lug 150 bears on the upper end of opening 148. To finally fix the slip seat 64 to the mandrel 10, a slip seat retainer 56 is inserted through an opening 152 in the slip seat 64 and further into a notch 154 in the mandrel 10 (see FIGS. 23 & 27). Each of the slip seat 64 are attached to the mandrel 10 which does not deform the mandrel 10 in the identical manner. While a specific non-welding mode of attachment of slip seat 64 to mandrel 10 is disclosed, those skilled in the art will appreciate that other techniques for so joining those two components can be utilized without departing from the spirit of the invention.

Another feature of the apparatus A of the present invention is the manner in which the loading is transferred from the slip 50 to the slip seat 64 and into the mandrel 10. Each individual slip 50 transfers loading to the slip seat 64 which surrounds it, whereupon the loading through the shape of the slip 50 is transferred into the wall of the mandrel 10. There is no interaction between one slip 50 and its slip seat 64 and any other slip seat 64. The loading is transferred from each slip 50 into the wall of mandrel 10 through slip seat 64 rather than radially toward the center of mandrel 10, which would be a force that would tend to deform or crush the mandrel 10. Referring specifically to FIGS. 23 and 14 and 15, it can be seen that the edges 156 and 158 are preferably beveled with respect to the plane of the paper and there is a matching slope on surfaces 160 & 162 of the slip seat 64. Thus, taking into consideration the strength of the slip seat 64, the edge configuration of each slip 50 along surfaces 158 & 156 and the conforming surfaces on the slip seat 64 surfaces 160 & 162 are such that the resultant force from loading a slip 50 is a force that is merely close to tangential to the wall which comprises the mandrel 10. In the preferred embodiment, the angle is approximately 80 degrees, putting the greatest component of force closer to the tangential direction into the wall which comprises the mandrel 10 with a smaller component directed radially toward the central of the mandrel 10. Such angles can be placed in the slip 50 by repositioning it during the machining process. As can be seen in looking at FIG. 23, when the upward pull comes to each of the slips 50, they are guided by surfaces 160 & 162 to move radially outwardly to lock the apparatus A downhole, while at the same time, independently transferring load from each slip to its respective slip seat 64 through surfaces 160 & 162 which are preferably at a slope of about 80 degrees resulting in the largest component of force being transferred into the mandrel 10 in a near tangential manner.

Those skilled in the art will now appreciate that the above-described preferred embodiment has numerous advantageous over tools in the prior art. The apparatus A employs a mechanical lock which prevents premature settings. It uses a bolt-on piston housing 106 which allows for field replacements to obtain different forces for disabling the mechanical lock. The rupture disk 124 requires a predetermined pressure be applied before the lock mechanism L can release. The use of a bolt-on piston housing 106 also helps reduce the profile of the lock mechanism L and enables the provision of longitudinal passages 38 for the passage of mud and cement. The slips 50 are secured to slip seat 64 which are, in turn, connected to the mandrel 10 without welding. Each slip 50 is configured to direct applied loads into the mandrel 10 in a direction nearly approximating the tangential or into the wall of the mandrel 10. Thus there is less of a tendency to deform the mandrel as with designs of the prior art which simply move slips up cones. Additionally, as distinguished from other slip designs of the prior art, there is no interaction in sharing the load among the slips 50. Each slip individually distributes the load applied to it to the mandrel 10 through the slip seat 64. The piston assembly 126 through the use of cap 130 allows venting of fluids from passage 122 in the piston housing 106. The piston assembly 126 is free to move in both directions to react to thermal and other effects. The rupture disk 124 can be configured so that it ruptures at significantly higher pressures upon an excess of pressure in passage 122 as opposed to its normal operation where an increase in pressure from the mandrel 10 results in breaking of the rupture disk 124. Maximum use is made of the force generated by the piston assembly 126 through the lost motion between the lock dog release 100 and the lock dog retainer 92. Since rotation of the apparatus A is possible, provisions have been made to retain the arms 46 which are attached to the slips 50 against centrifugal force from such rotation. The slip seat retainer 56 accomplishes this function. Yet another new feature is the drop-in arrangement for the slip seat 64 into the slots 140 and opening 148. The dove-tail arrangement also helps to secure the slip seat 64 to the mandrel 10. The edge slopes on the slips 50 are designed to avoid over-stressing the slip seat 64 while at the same time efficiently communicating loads on each slip 50 into the wall which defines the mandrel 10.

Referring now through FIGS. 30 through 36, an alternative embodiment is described. As shown in FIGS. 30A through C, a mandrel 160 has a series of slips 162 retained in a similar manner as previously described for the slips 50. What is different in the alternative embodiment can be seen in FIG. 33A where a passage 164 leads from internally of the mandrel 160 to a rupture disk 166. On the other side of the rupture disk 166 is a piston assembly 168. These components operate in the identical manner as described for the comparable structure in the preferred embodiment. Looking at FIG. 32B, a spring housing 170 is locked to the mandrel 160 by virtue of the fact that a split ring 172 extends into a groove 174 in the mandrel 160. The split ring 172 also extends into a recess 176 in spring housing 170. A spring 178 is shown in FIG. 32B. Those skilled in the art will appreciate it as one of many springs 178, each of which is guided by a guide 180. Referring to FIG. 31, the lower end 182 of the spring housing 170 has a recess 184 which accepts a tab 186 which is part of the structure of the slip 162. Accordingly, the spring housing 170 is operably connected to all the slips 162 and has numerous springs 178 which will drive all the slips 162 upward as the spring housing 170 moves upwardly once the split ring 172 is moved out of the way. This occurs when the split ring 172 is allowed to expand effectively out of groove 174 thereby no longer restraining the spring housing 170 and thus allowing the force of all the springs 178 to move the slips 162 upwardly, thus distributing the load on each of the slips 162 in the manner previously described for the preferred embodiment. The split ring 172 is shown in FIG. 34. It has a pair of opposed shoulders 188 & 190 which are tightly squeezed together by a yoke 192 (shown in FIG. 35). Yolk 192 has a pair of opposed surfaces 194 & 196 which engage surfaces 190 & 188 respectively to hold the position of the split ring 172 to a diameter sufficiently small so that it can effectively serve as an anchor when fixed in groove 174. The release simply occurs by a pressure buildup in the mandrel 160 which is communicated through passage 164 to break rupture disk 166 which in turn actuates the piston assembly 168. The piston assembly 168 engages a connecting rod 198 which is fixedly secured to the yoke 192. When the surfaces 194 & 196 on yoke 192 are displaced from the surfaces 190 & 188 on split ring 172, the split ring 172 can expand radially outwardly, thus defeating the lock of the spring housing 170 to the mandrel 160. When this occurs, the springs 178 can bias the spring housing 170 upwardly, thus taking up all the slips 162 and securing the apparatus A while distributing the load into the mandrel 160 in the manner previously described.

Yet another feature of the alternative embodiment can be seen from FIGS. 31 & 36. As shown in FIG. 36, a flow channel 200 on the back side of each slip 162 allows mud or cement flow underneath to permit circulation of such materials during the normal operation of the apparatus A. This is significant in this particular design because it does not have the feature of the longitudinal passages 38 as in the preferred embodiment. However, in common with the preferred embodiment, pressure in the mandrel 160 results in defeat of a lock mechanism (in this embodiment the split ring 172). The slips 162 are independently set with the spring force from springs 178. This mode of operation is to be contrasted with that revealed in U.S. Pat. No. 5,417,288 where the pistons actuate a ring which is directly connected to the slips. Thus, in that design the hydraulic pressure actually moves the slips whereas in this alternative embodiment, as well as in the preferred embodiment, the applied hydraulic pressure, without breaking any components other than a rupture disk such as 124 and shear pin 76, results in the release of a mechanical lock which allows the independent operation of the setting of the slips 50. Again, comparing to the previous technique of U.S. Pat. No. 5,417,288, numerous passages have to be drilled in the mandrel. More specifically, two passages were needed for each slip to operate it. Here, a single passage is presented through the mandrel 160 to operate the connecting rod 198 so as to release the split ring 172 from the groove 174 thus allowing independent mechanical actuation using spring force to set the slips 162.

Referring to FIG. 36*a*, one alternative embodiment of the liner hanger is composed of a mandrel 201 which has a lower end 217. The lower end is shown schematically and those skilled in the art will appreciate that the liner string is connected at the lower end 217. The mandrel 201 has an upper end 216 which, to those skilled in the art will appreciate, is attached to a running tool for proper positioning and securing of assembly S shown in FIGS. 36*a* through 38.

Referring to FIG. 36*a*, a piston assembly 202 is secured to the mandrel 201 using a bolt 110 previously described. Secured loosely by the piston assembly 202, is a lock bar 203, which connects to the snap ring 204, which extends into a recess 205 (FIGS. 39 and 40) on the mandrel 201, and is retained in place by a breakable pin 206. The pusher sleeve 207 is biased against the snap ring 205 through the t-slot segment 212, which is biased by the slip 50, which is biased by the spring 60 through the spring guide 62.

One alternative embodiment of the piston housing 223 can best be seen in FIG. 39 in the run-in and FIG. 40 in the set position, where the end of the piston housing 223 has been extended to present a cover 218 over the lock bar 203 to prevent shifting of the lock bar 203 by means other that the piston 126. The lock bar 203 is similar to the yoke 192 in that it combines the yoke 192 and the connecting rod 198 from the previous description. The lock bar 203 has a pair of opposed surfaces 219 & 220 (FIG. 42) which hold the opposed shoulders 212 & 222 (FIG. 43) respectively of the snap ring 204 and secure the snap ring 204 in the recess 205 in the mandrel 201. This method demonstrates that the snap ring 204 can be restrained from the top or the bottom without departing from the spirit of the invention.

Figure 6:
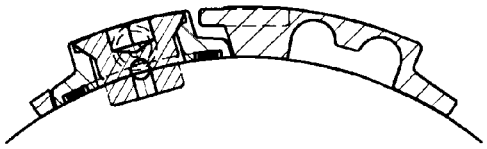
FIG. 6 is a section through lines 6—6 of FIG. 2.

Another alternative embodiment of the piston housing 223 is that it can be mounted on a milled flat FIG. 41 on the mandrel, verses mounting on a curved surface FIG. 6 of the mandrel 201 & 10 without departing from the spirit of the invention.

The alternative embodiment of the slip seat 209, where the springs 60 are contained in the slip seat 209 and bias the slips from the bottom, indirectly through a collection of parts, against the snap ring 205 and lock bar 203, also demonstrates that the slips 50, can be pushed versus pulled, to set the slips 50 without departing from the spirit of the invention.

Further modifications to the equipment and to the techniques described herein should be apparent from the above description of these preferred embodiments. Although the invention has thus been described in detail for a preferred embodiment, it should be understood that this explanation is for illustration, and that the invention is not limited to the described embodiments. Alternative equipment and operating techniques will thus be apparent to those skilled in the art in view of this disclosure. Modifications are thus contemplated and may be made without departing from the spirit of the invention, which is defined by the claims.

We claim:

1. A liner hanger comprising:

a body;

a plurality of slips mounted to individual seats on said body, said individual seats substantially surrounding a respective slip such that upon actuation of said slips load is transferred to said body from each slip substantially peripherally through its individual seat.

2. The hanger of claim 1, wherein:

said seats transfer load applied through each slip, when set, in a substantially tangent direction to said body.

3. The hanger of claim 1, wherein:

said slips and their respective seats make contact along matting edge surfaces which transmit a majority of the force applied to the slip into said body tangentially.

4. A liner hanger comprising:

a body;

a plurality of slips mounted to individual seats on said body such that upon actuation of said slips load is transferred to said body from each slip through its individual seat;

said seats are attached to said body without welding.

5. A liner hanger comprising:

a body;

a plurality of slips mounted to individual seats on said body such that upon actuation of said slips load is transferred to said body from each slip through its individual seat said seats are circumferentially spaced from each other creating longitudinal passages outside said body where wellbore fluids can flow.

6. A liner hanger comprising:

a body;

a plurality of slips mounted to individual seats on said body such that upon actuation of said slips load is transferred to; said body from each slip through its individual seat;

a lock to retain said slips in a retracted position for run in;

a release mechanism removably mounted to an exterior surface of said body for selective contact with said lock to allow said slips to set.

7. The hanger of claim 6, further comprising:

an actuation assembly on said body which selectively applies a force to set said slips after said lock has been defeated by movement of said release mechanism.

8. The hanger of claim 7, wherein:

said release mechanism comprises a housing having a passage which communicates with an opening in said body and a movable piston in said housing;

whereupon, pressure from said body into said housing moves said piston against said lock to allow said actuation assembly to set said slips.

9. The hanger of claim 8, wherein:

said housing is retained by a fastener which is inserted into the opening in said body and has a passage therethrough to allow fluid communication to said piston.

10. The hanger of claim 8, wherein:

said piston is free to move in said housing to compensate for thermal effects from surrounding wellbore fluids.

11. The hanger of claim 8, further comprising:

a removable member in said housing which is responsive to applied pressure from said body to insure pressure buildup to a predetermined level prior to communicating said pressure to said piston.

12. The hanger of claim 6, wherein:

said lock comprises at least one dog retained to said body by a biased sliding sleeve assembly, said sliding sleeve assembly comprises a plurality of components connected to each other to provide for initial relative movement followed by tandem movement when contacted by said release mechanism to release said dog from said body.

13. The hanger of claim 12, wherein:

a first component of said sliding sleeve assembly which is initially contacted by said release mechanism is initially secured to said body;

whereupon contact of said first component by said release mechanism said secured connection to said body is disconnected while leaving a second component of said sliding sleeve assembly initially undisturbed.

14. The hanger of claim 13, wherein:

said body comprises a plurality of openings and each seat comprises tabs to enter respective openings whereupon relative longitudinal movement between said seat and said body moves said seat to a secure position where said seat can't move away from said body.

15. The hanger of claim 6, wherein:

said lock comprises a biased sleeve held to said body by a split ring held together by a yoke, whereupon when said yoke is displaced by said release mechanism said split ring expands to release said sleeve to be biased which in turn moves said slips to a set position.

16. The hanger of claim 6, wherein:

said lock comprises a split ring which is held by a yoke to said body, to retain said slips against a bias force, said release mechanism moving said yoke to allow said bias force to set said slips.

17. A liner hanger comprising:

a body;

a plurality of slips mounted to individual seats on said body such that upon actuation of said slips load is transferred to said body from each slip through its individual seat;

a retainer for at least one slip to counteract a separation force from rotation of said body.

18. A liner hanger, comprising:

a body;

a plurality of slips, said slips actuable by a bias force stored in said body and applied to a connected sliding sleeve;

a lock selectively retaining said sleeve to said body;

a pressure operated release mechanism on said body to selectively move said lock to allow said sliding sleeve to be biased by said stored force to move said slips to a set position.

19. A liner hanger, comprising:

a body;

a plurality of slips, Said slips actuable by a bias force applied to a connected sliding sleeve;

a lock selectively retaining said sleeve to said body;

a release mechanism on said body to allow said biased sliding sleeve to move said slips to a set position:

said release mechanism is removably secured to said body by a fastener to allow different release mechanisms to be used on the same body.

20. The hanger of claim 19, wherein said release mechanism comprises a housing having a piston in a chamber therein, said body having an opening and said fastener providing communication through itself from said opening in said body to said piston in said chamber.

21. A liner hanger, comprising:

a body;

a plurality of slips, said slips actuable by a bias force applied to a connected sliding sleeve;

a lock selectively retaining said sleeve to said body;

a release mechanism on said body to allow said biased sliding sleeve move said slips to a set position;

said slips are individually supported by seats which are circumferentially spaced and secured to said body without welding whereupon loads transferred from said slips to their respective seats are principally tangentially transferred into said body.

* * * * *